United States Patent [19]

Alban

[11] 4,066,051

[45] Jan. 3, 1978

[54] TRAINING AID FOR ARCHERY

[76] Inventor: John M. Alban, 173 Fr. Zeiser Place (W. 188th St.), Bronx, N.Y. 10468

[21] Appl. No.: 466,200

[22] Filed: May 2, 1974

Related U.S. Application Data

[63] Continuation-in-part of Ser. No. 156,796, June 25, 1971, abandoned.

[51] Int. Cl.[2] ..... F41B 5/00

[52] U.S. Cl. ..... 124/86; 124/24 R

[58] Field of Search ..... 124/30 R, 1, 35, 23 R, 124/24 R, 80, 86; 211/16, 34, 64

[56] References Cited

U.S. PATENT DOCUMENTS

| | | | |
|---|---|---|---|
| D. 161,354 | 12/1950 | Manuel | 211/34 |
| 3,055,354 | 9/1962 | Gates | 124/23 R X |
| 3,446,200 | 5/1969 | Gross | 124/24 R |
| 3,517,657 | 6/1970 | Alban | 124/24 R UX |
| 3,557,769 | 1/1971 | Hofmeister | 124/24 R |

*Primary Examiner*—Richard C. Pinkham
*Assistant Examiner*—William R. Browne

[57] ABSTRACT

A training aid for archery, which permits relief of the bow tensioning force on the archer's shooting arm by transferring the force to the gripping action of both hands, embodying a spanning member having means at each end adapted to be gripped by the hands of the archer one in conjunction with the bow and the other in conjunction with the string and the end of the arrow, which spanning member is appropriately formed to avoid interference with the action of the string. An attachment is also provided for tying the spanning member to the drawing arm of the archer to maintain the arm in proper alignment with the arrow during aiming and which attachment is pivoted with respect to the spanning member to facilitate the withdrawing of the next arrow from the quiver after each firing.

10 Claims, 8 Drawing Figures

INVENTOR.
JOHN M. ALBAN

TRAINING AID FOR ARCHERY

This is a continuation-in-part of my copending application Ser. No. 156,796, filed June 25, 1971, now abandoned.

BACKGROUND OF THE INVENTION

The centuries-old problem of the archer of attempting to aim while exerting the proper force in tensioning his bow was solved by the development of the crossbow which transferred the tensioning stress from the arms of the archer to a mechanism with mechanical advantage thus permitting improved aiming and increased range in firing. While this development revolutionized the art, the subsequent invention of gunpowder caused the art of archery to fall into decline until today it is primarily used in sport. However, due to its extreme accuracy and power, the crossbow is not generally regarded as a sporting weapon and it has been outlawed as a hunting weapon in most states. The hunting archer therefore is again cast in the role of the ancient archer, being required to tension his bow primarily with his arms. The novice in this sport must thus concern himself with the problem of drawing back the bow string with tensions of the order of 45 pounds and maintaining this tension with his out-stretched shooting arm while attempting to keep his drawing arm in alignment with the arrow before even beginning to take aim at his target. Probably the most difficult part of this operation to the beginner is the maintaining of the tension in his shooting arm while attempting to hold the bow steady in aiming.

Various devices directed to this problem have been developed which disclose the use of a bar which is fastened at one end to the bow and has an up-standing handle at its opposite end by which the archer can relieve the tension on his shooting arm, after he has drawn back the string, by gripping the handle in conjunction with the string. While such devices have their usefulness, they still do not permit the archer to exercise the natural rhythmic action that he must practice to develop his skill. Further the fastening of the bar to the bow renders the rigid composite weapon somewhat clumsy to handle and the bar may interfere with the action of the string if the shooting angle is varied. Also, once tensioned it is difficult to disarm the weapon without firing the arrow. Although, various adjustable features have been incorporated in such apparatus to make them more versatile, the time and trouble required to accomplish the adjustments may often prove frustrating to the beginner.

Accordingly, the present invention provides a device of simple construction, which permits the archer to relieve the tension on his shooting arm and yet which will not interfere with the natural shooting motion or varying of the shooting angle. The device offers complete versatility in the use of the bow and may be used with a suitable attachment to insure proper alignment of the archer's drawing arm with the arrow while practicing proper aiming.

SUMMARY OF THE INVENTION

The device of the present invention comprises a lightweight rod or spanning member having means at both ends suitable for gripping by the archer one in conjunction with the bow and the other in conjunction with the string and the arrow. The gripping means may be in the form of two handles extending substantially at right angles to the axis of the spanning member and off-set from the axis so that the member will not interfere with the action of the string while the handles are gripped by the archer. As the archer prepares to draw, he may grip the handle at one end of the spanning member along with the string and the end of the arrow in his drawing hand, while permitting the opposite end of the spanning member to pass between the fingers on the hand gripping the bow. When the string is drawn to the proper tension the tensioning force which is being maintained by the shooting arm may be transferred by gripping the handle on the forward end of the spanning member along with the bow so that the gripping action of both hands then maintains the tension. The shooting angle may be easily varied and, if desired, the tension may be released without firing the arrow by releasing the grip on the handle on the forward end of the spanning member and again permitting the member to pass between the fingers of the bow gripping hand. After firing, the archer may easily reload by also sliding the member forward between his fingers so that it does not interfere with his drawing arm in placing the next arrow in position.

A further feature of the present invention is the inclusion of an attachment which can be connected to the spanning member and tied on the drawing arm of the archer to insure proper alignment of the arm with the arrow in practicing proper aiming techniques. The attachment may be pivotally connected to the spanning member so as not to interfere with the natural rhythmic motion of the archer in rapid firing.

DETAILED DESCRIPTION OF THE INVENTION

Figures 1, 2, 3, 4, 5, 6, 7, 8:
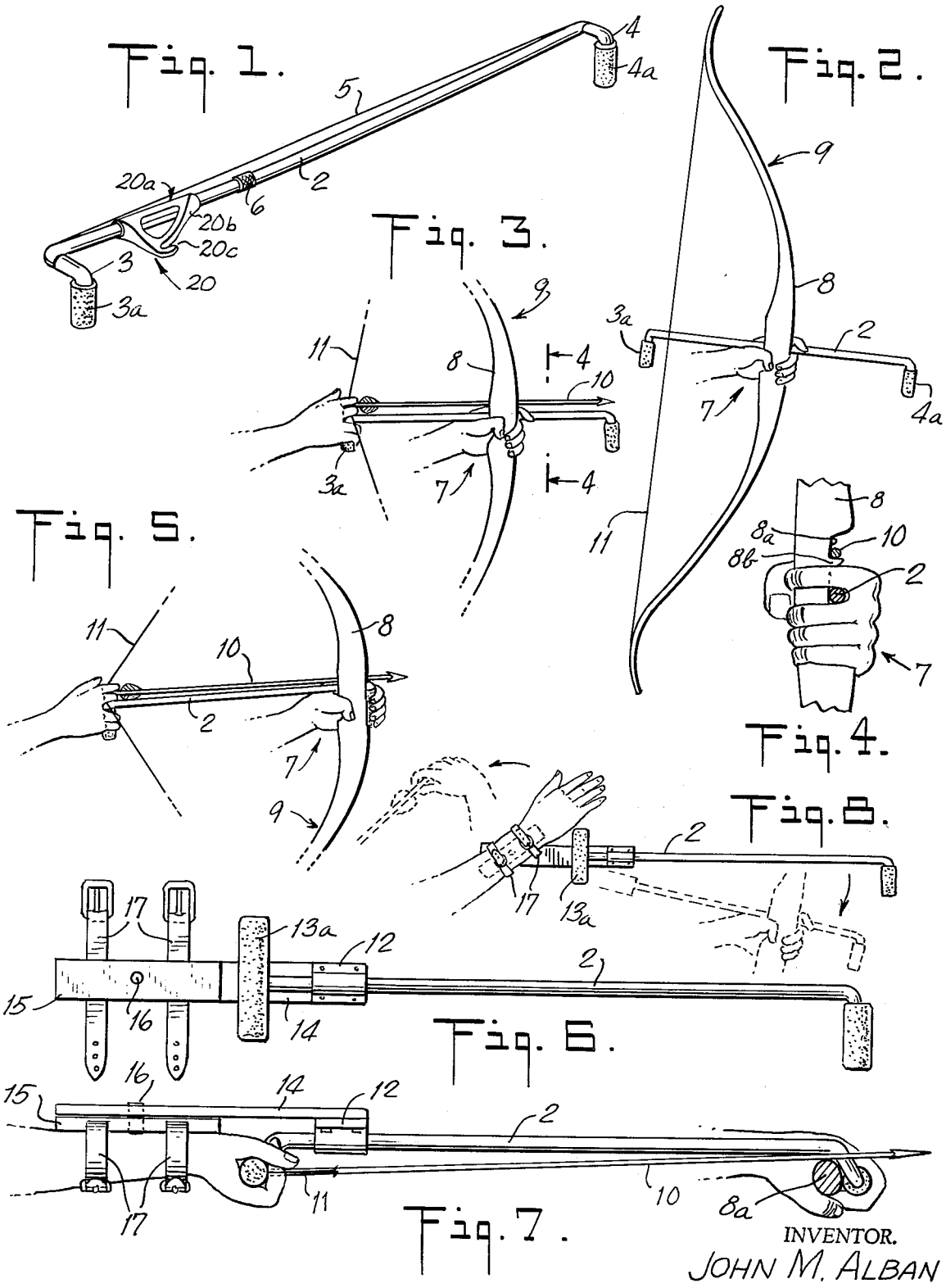
FIG. 1 is a perspective view of the training aid of the present invention.
FIG. 2 is a side view of the hand of an archer illustrating how the training aid may be held in conjunction with the bow before or after firing, or when drawing an arrow preparatory to firing.
FIG. 3 is a view as in FIG. 2 illustrating the loading of an arrow.
FIG. 4 is an enlarged front view of the archer's grip taken along the lines 4—4 in FIG. 3.
FIG. 5 is a view as in FIG. 2 illustrating the use of the training aid during aiming.
FIG. 6 is a side view of the training aid with an aim improving attachment thereon.
FIG. 7 is a top view partly in section of the apparatus shown in FIG. 6 illustrating its use during aiming.
FIG. 8 is a partial side view of an archer illustrating the action of drawing an arrow with the aim improving attachment on the drawing arm.

The training aid of the present invention as shown in FIG. 1 comprises an elongated rod-like portion or spanning section 2, on each end of which suitable gripping members 3 and 4 are formed. The training aid may be formed from a steel rod, aluminum tubing or similar metal stock having a good degree of rigidity. The gripping members 3 and 4 on each end may be separately attached or may be formed by suitably bending the ends of the rod 2 and providing hand gripping means or handles **3*a* and 4*a* on the bent ends. As it is difficult to find a lighweight material with the optimum degree of rigidity, the rod may be somewhat pre-stressed by attaching a suitable steel cable 5** to each of the ends coextensive with the spanning section and causing it to bow slightly inwardly in the direction of the gripping members or handles.

The gripping members 3 and 4 (as will be seen in FIG. 7) are suitably off-set from the axis of the spanning section to avoid interference with the action of the string during firing. The off-set may be accomplished in the case of an integral rod by gradually bending the stock in the plane of the spanning section and then abruptly bending the extreme ends transversely at substantially right angles with respect to the plane of the spanning section. If it is desired to provide separate handles 3*a* and 4*a*, they may be attached to the off-set portions of the rod.

As most bows at full capacity have approximately a twenty-eight inch draw length, the span of the training aid will ordinarily be 28 inches from handle to handle. However, to permit a versatility in drawing or to accommodate to a comfortable drawing length for a particular archer, the spanning member, rather than being made from an integral piece of stock, may be made from two telescoping portions permitting adjustment of the length. The two portions may be secured after the desired length is established by means of a conventional set screw arrangement 6, or suitable collar means.

The proper use of the training aid of the present invention is illustrated in FIGS. 2 – 4. The archer 7, when gripping the bow handle 8 prior to loading the bow 9 with an arrow 10, places the spanning section of the training aid between the index and middle fingers against the inner wall of the bow window 8*a* as illustrated in FIG. 4. The aid or rod may be rested on the base of the window 8*a* to facilitate the sliding of the training aid back and forth on the bow 9 during the arming and re-loading actions.

Now, as shown in FIG. 3, the rear handle 3*a* of the training aid is gripped by the drawing hand of the archer 7 together with the string 11 and the end of the arrow 10, with the arrow end gripped between the index and middle fingers in the ordinary manner. The handle will ordinarily be gripped by the four fingers of the drawing hand as shown in FIG. 3 but in the alternative, or when an extended grip such as shown in FIG. 6 is used, the rod may be permitted to extend between the middle and ring fingers while gripping the end of the arrow in the ordinary manner. If the bow window 8*a* is provided with a separate arrow rest 8*b*, as shown in FIG. 4, the forward portion of the arrow shaft may be rested thereon, but in the absence of a separate arrow rest, the shaft may be rested on the upper surface of the training aid and the index finger placed beneath the aid.

The archer now being ready to tension the bow draws back his drawing hand, while simultaneously gripping the string 11, the arrow end, and the training aid handle 3*a*, while permitting the forward portion of the training aid to slide along the base of the bow window between his fingers. When nearing the end of the draw, the fingers of the bow-holding hand may be extended to permit the forward handle 4*a* to pass into the palm of the hand whereupon the fingers are closed, gripping the handle in conjunction with the handle of the bow as shown in FIG. 5. It will be seen that when the forward handle 4*a* of the training aid and the bow handle 8 are gripped, the stress that has been built up in the bow-holding arm in tensioning the bow is released and the bow-tensioning force is maintained by the gripping action of each of the archer's hands. The archer may then fire by simply releasing the string and arrow with the two fingers of the drawing hand in the normal manner.

An important feature of the present invention is that unlike devices of the prior art which are fastened to the bow handle, with the present device the archer may, after arming, disarm his bow without firing the arrow. This is accomplished by releasing his grip on the forward handle 4*a* of the training aid, thus transferring tension back to his bow-holding arm, and then easily sliding the training aid forward between his fingers to release the tension on the bow. This is a particularly valuable feature for beginners who may wish to continuously practice the actual arming of the bow without having to fire an arrow after each time the bow is tensioned.

Accordingly, after either firing or disarming, the training aid will be returned to essentially the position shown in FIG. 2. The archer may then acquire another arrow for subsequent firing, or re-arm his bow, in the described manner. It also will be seen that the training aid of the present invention is basically safer than the prior art devices which are fastened to the bow handle, since in those devices, if upon releasing the string, the archer forgets to maintain a proper stress in the bow-holding arm, there is a tendency for the bow to spring toward the archer, poking him with the spanning member rigidly fixed thereon. Further, as will be understood upon reference to FIG. 2, the present training aid is superior to the prior art fixed devices when loading or arming the bow, since the rear handle of the training aid may be positioned at the location of the untensioned string and the handle and string may be simultaneously gripped before beginning the tensioning operation. In the prior art devices, the string must be drawn all the way back to the handle and the handle gripped when the bow is fully tensioned. The desirability of the former situation, particularly in the case of beginners, is manifest.

A modification of the training aid of the present invention incorporating an aim-improving and rapid-fire attachment is shown in FIGS. 6 – 8. The training aid in this embodiment is essentially similar to the first-described embodiment with the exception that the rear handle 13*a* is formed with an up-standing portion which for some archers, may facilitate the gripping of the handle in conjunction with the string and the end of the arrow. The aim-improving attachment is suitably connected to the aftward portion of the spanning section such as by means of a surrounding piece 12 which may be slideable on the spanning rod to permit longitudinal adjustment of the aim-improving means. The sliding surrounding piece 12 may be screwed or otherwise fastened to a plate member 14. The aim-improving attachment, more particularly, comprises two plate members, one 14 attached to the surrounding piece 12, and the other 15 pivotally attached to the first plate by suitable pivot means 16, such as a rotatable rivet or other connection. The second plate 15 is fitted with two straps 17 or other means, such as arm clips, for attachment to the drawing arm of the archer as shown in FIG. 7. As also seen in FIG. 7, the two plates 14 and 15 are aligned with the axis of the spanning member and when fixed to the arm of the archer, maintain the arm in proper alignment with the string 11 and bow 9 when the drawing hand grips the training aid handle 13*a* in combination with the string 11 and the end of the arrow 10. Thus, the combination of the training aid and the aim improving attachment permits the beginner to relax the stress in his bow-holding arm so that he may more easily align the bow with the target and also maintains his drawing arm in proper alignment with the bow so that the desired directing of the arrow toward the target is achieved.

FIG. 8 illustrates how the pivoting of the two plate members 14 and 15 in the aim-improving attachment facilitates re-loading by constraining the aft end of the training aid to move backwardly with the drawing arm when drawing another arrow from the quiver. Thus, after firing, the archer may quickly reach back to the quiver without concern for the location or position of the training aid, and the forward portion of the training aid is held in conjunction with the bow by the other hand as in the normal use of the device.

A further feature of the present invention is shown in FIG. 1 in the form of a knocking device 20 which can be used by the archer to hook the training aid to the unstressed bow string allowing the aid to be rested on the bow without being held by the hands of the archer. The device 20 may comprise a portion 20*a* for attachment to the aid and a cantilever means 20*b* having a suitable notch 20*c* formed at its extreme for accommodating the bow string. In use, the training aid may then be handled in the manner of an arrow for practicing, knocking, drawing and firing and while carrying the aid with the bow.

What is claimed is:

1. An archery training aid for use with a longbow having a central bow handle disposed between two limb members and a bow string attached at opposite ends to and tautly spanning the free ends of said limb members, said aid comprising:

a. means for spanning a central bow handle and a bow string of a drawn longbow, said spanning means having a thickness adapted to permit it to pass between two fingers of an archer so that prior to drawing a longbow the forward end of said spanning means may be held by one hand of an archer along with a central bow handle, while the other hand of the archer grasps a bow string and the opposite end of said spanning means;

b. a first handle at said opposite end of said spanning means, said first handle having a thickness adapted to permit it to be gripped by a drawing hand of an archer along with a bow string and an end of an arrow;

c. a second handle at the forward end of said spanning means, said second handle being oriented transversely to the axis of said spanning means and having a thickness adapted to permit it to be gripped by a bow-gripping hand of an archer in conjunction with a central bow handle for securing said second handle to a central bow handle when a longbow is drawn; and d. a knocking member mounted on said spanning means adjacent said second handle and having a notch therein for accommodating a bow string.

2. An aid as in claim 1, wherein said spanning means comprises an integral rod and the first and second handles comprise end extensions on said rod bent so as to be offset from the axis thereof.

3. An aid as in claim 2 wherein each of said end extensions comprises an offset portion and a portion bent substantially at right angles with respect to said offset portion.

4. An aid as in claim 3 wherein said right angle portions comprise hand grip means for gripping by two hands of an archer.

5. An aid as in claim 1 further comprising means for pre-stressing said spanning member.

6. An archery training aid for use with a longbow having a central bow handle disposed between two limb members and a bow string attached at opposite ends to and tautly spanning the free ends of said limb members, said aid comprising:

a. means for spanning a central bow handle and a bow string of a drawn longbow, said spanning means having a thickness adapted to permit it to pass between two fingers of an archer so that prior to drawing a longbow the forward end of said spanning means may be held by one hand of an archer along with a central bow handle, while the other hand of the archer grasps a bow string and the opposite end of said spanning means;

b. a first handle at said opposite end of said spanning means, said first handle having a thickness adapted to permit it to be gripped by a drawing hand of an archer along with a bow string and an end of an arrow;

c. a second handle at the forward end of said spanning means, said second handle being oriented transversely to the axis of said spanning means and having a thickness adapted to permit it to be gripped by a bow-gripping hand of an archer in conjunction with a central bow handle for securing said second handle to a central bow handle when a longbow is drawn; and d. attaching means on said spanning means for attaching said spanning means to a drawing arm of an archer.

7. An aid as in claim 6, wherein said attaching means comprises:

c. first means for connecting said attaching means to said spanning means, d. second means for tying said attaching means to a drawing arm of an archer; and e. third means for pivotally connecting said first means and said second means to permit the pivoting of the spanning means with respect to a drawing arm of an archer.

8. An aid as in claim 7, wherein said first means and said second means each comprise plate members having their planes parallel to each other and the axis of said spanning means.

9. An aid as in claim 8 wherein said second means further comprises strap means for attaching said second plate member to a drawing arm of an archer.

10. An aid as in claim 6 further comprising knocking means mounted on said spanning member and said knocking means having a notch therein for accommodating a bow string.

* * * * *